US011033795B1

(12) United States Patent
Berrios

(10) Patent No.: US 11,033,795 B1
(45) Date of Patent: Jun. 15, 2021

(54) SCOREBOARD

(71) Applicant: Gregorio Berrios, Carrollwood, FL (US)

(72) Inventor: Gregorio Berrios, Carrollwood, FL (US)

( * ) Notice: Subject to any disclaimer, the term of this patent is extended or adjusted under 35 U.S.C. 154(b) by 92 days.

(21) Appl. No.: 16/514,245

(22) Filed: Jul. 17, 2019

(51) Int. Cl.
*A63B 71/06* (2006.01)

(52) U.S. Cl.
CPC ..... *A63B 71/0672* (2013.01); *A63B 2210/50* (2013.01)

(58) Field of Classification Search
CPC ..... A63B 71/0672
See application file for complete search history.

(56) References Cited

U.S. PATENT DOCUMENTS 2,115,770 A * 5/1938 Hartzell ..... G09F 11/12 116/222
2,608,011 A * 8/1952 Ten Hoeve ..... G09F 3/20 40/536
3,246,411 A * 4/1966 Aafedt ..... A63B 71/0672 116/222
4,751,506 A 6/1988 Brown
5,615,636 A * 4/1997 Gustafson ..... A63B 71/0672 116/223
D432,031 S * 10/2000 Miller ..... D10/46.1
7,117,619 B1 * 10/2006 Huber ..... A63B 71/0672 40/495
7,898,393 B2 3/2011 McMillan
D774,403 S * 12/2016 Iler ..... D10/46.1
2011/0247545 A1 * 10/2011 Degirmenci ..... A63B 71/0672 116/222

* cited by examiner

*Primary Examiner* — Justin S Lee
(74) *Attorney, Agent, or Firm* — Sanchelima & Associates, P.A.; Christian Sanchelima; Alexander Rodriguez

(57) ABSTRACT

A scoreboard for displaying scores in a sporting event or other recreational event is disclosed herein. The scoreboard comprises a base member, a support member, a plurality of cards and a ring member. The support member is disposed above the base member. The plurality of cards is arranged in at least three stacks along the length of said support member. Each of said cards defining at least one fastening aperture and indicia. The ring member is threaded through each of the fastening apertures in the cards and the support member. The scoreboard allows a scorekeeper to accurately display the score, and easily observe the movement of players to either side of a court. The scoreboard is simple in construction, easy to use, and eliminates the need of handling two large cards side by side.

18 Claims, 3 Drawing Sheets

SCOREBOARD

BACKGROUND OF THE INVENTION

1. Field of the Invention

The present disclosure relates to a device or an apparatus for displaying scores in a sporting event. More particularly, the present disclosure relates to a scoreboard for displaying scores in sporting events or other recreational events.

2. Description of the Related Art

Volley ball such as court style and beach volley ball, and racket and paddle sports have huge numbers of recreational participants. Some of the more popular racket and paddle sports include tennis, racquetball, badminton, ping pong, etc. A common problem encountered by recreational players and score keeper is losing track of the score. Various mechanical and electrical scoreboards have been developed and are available for indicating or displaying the score during sporting events. Most of these scoreboards are large in size and permanent fixtures in stadiums or playing fields. The increased interest on organized sports at community levels, as well as sports in more casual situations in neighborhood parks and community playing fields, has resulted in a need for portable, easy to use, scoreboards with simple procedure for tracking and efficiently display the score.

Several devices have been designed in the past. None of them, however, include a scoreboard that is capable of addressing the foregoing discussed issues.

Applicant believes that a related reference corresponds to U.S. Pat. No. 7,898,393 filed by Kris Phillip McMillan describes a wall-mounted scoreboard. Kris reference discloses a wall mounted scoreboard configured to be used in a home or commercial establishment. The scoreboard includes a back cover, a cover panel and a display panel. The back cover has a front open face and the cover panel is applied over the front face of the back cover. The display panel is interposed between the back cover and the cover panel. The display panel has changeable indicators arranged in information blocks that are in registry with the windows in the cover panel. The cover panel includes graphics which display a designator for each information block, the designators corresponding to game data. The scoreboard includes a wireless receiver and a control. The wireless receiver receives status information broadcast wirelessly from a game in progress and the control causes the display panel to display the status information thereon within the information blocks. However, Kris reference lacks to provide a simple solution and an efficient scoreboard construction for tracking and displaying score.

Another related reference is U.S. Pat. No. 4,751,506 filed by Colin T. Brown describes a scoreboard device. Colin reference discloses a display device for displaying numerical results of athletics and/or games and the like. The display unit includes at least one array of printed circuit board for displaying numerals which can be controlled by electrical signals derived from a clock generator in the control unit so as to produce a rising or falling numerical value corresponding to the time which has accumulated or lapsed depending on the activity. However, the electrical based display device of Colin reference is not suitable for use in home establishment or recreational events.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a scoreboard for sporting events or other recreational events.

It is an object of the present invention to provide a scoreboard for indicating or displaying single digit score, double digit score and number of games won with a simple procedure.

It is another object of the present invention to provide a simple, inexpensive and portable scoreboard.

It is yet another object of the present invention to provide a scoreboard suitable for both indoor and outdoor events or games.

It is yet another object of the present invention to provide a scoreboard comprising a base member, a support member disposed above the base member and a plurality of cards arranged in at least three stacks, said stacks aligned in spaced relation along the length of said support member, said cards in a first stack have numbers from zero through nine sequentially to indicate a number of games won, said cards in a second stack have single digit numbers sequentially to indicate single digit score, and said cards in a third stack have two-digit numbers sequentially to indicate two-digit score.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
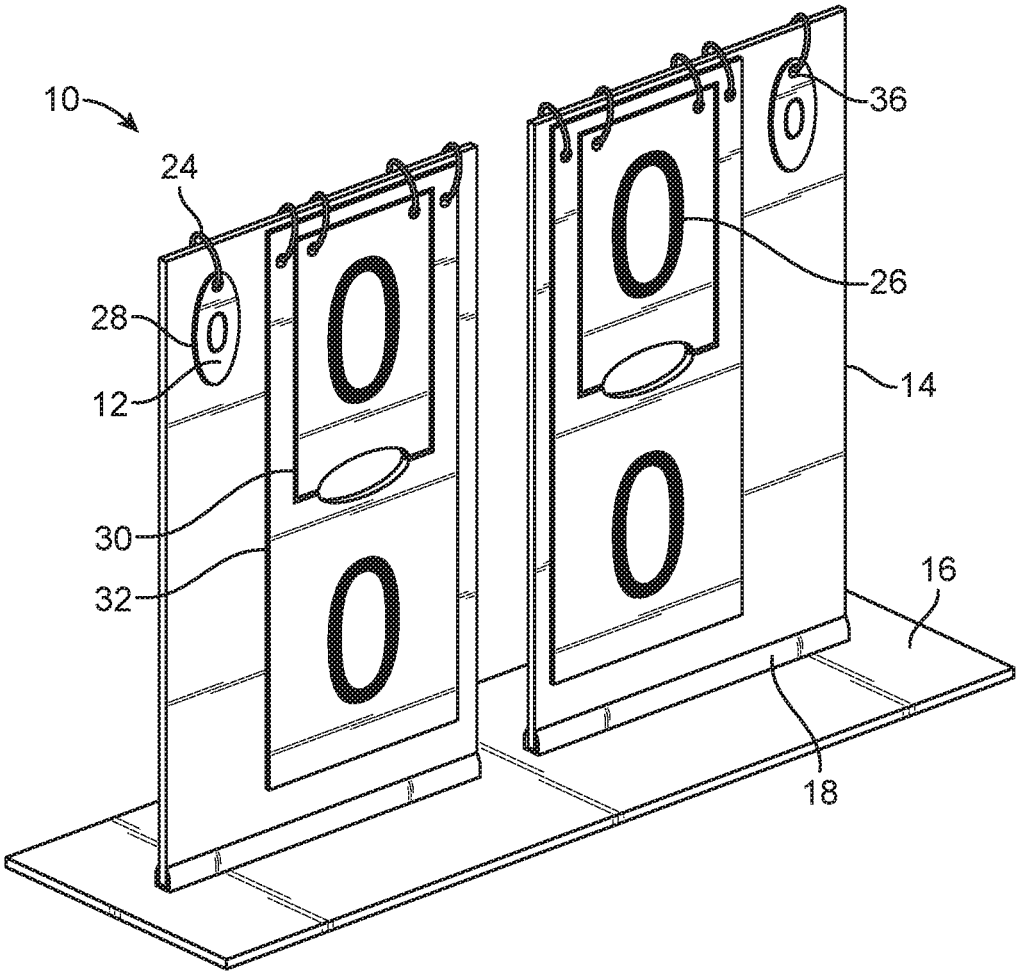
FIG. 1 exemplarily illustrates a perspective view of a scoreboard 10 in an embodiment of the present invention. The scoreboard 10 comprising a base member 16, a support member 14 disposed above the base member 16 and a plurality of cards 12 arranged in at least three stacks (28, 30, and 32) is illustrated. A plurality of ring members 24 is aligned in spaced relation along a length of an upper portion of the support member 14, a plurality of cards 12 having indicia 26 are suspended from the ring members 24, is also illustrated.
Figure 2:
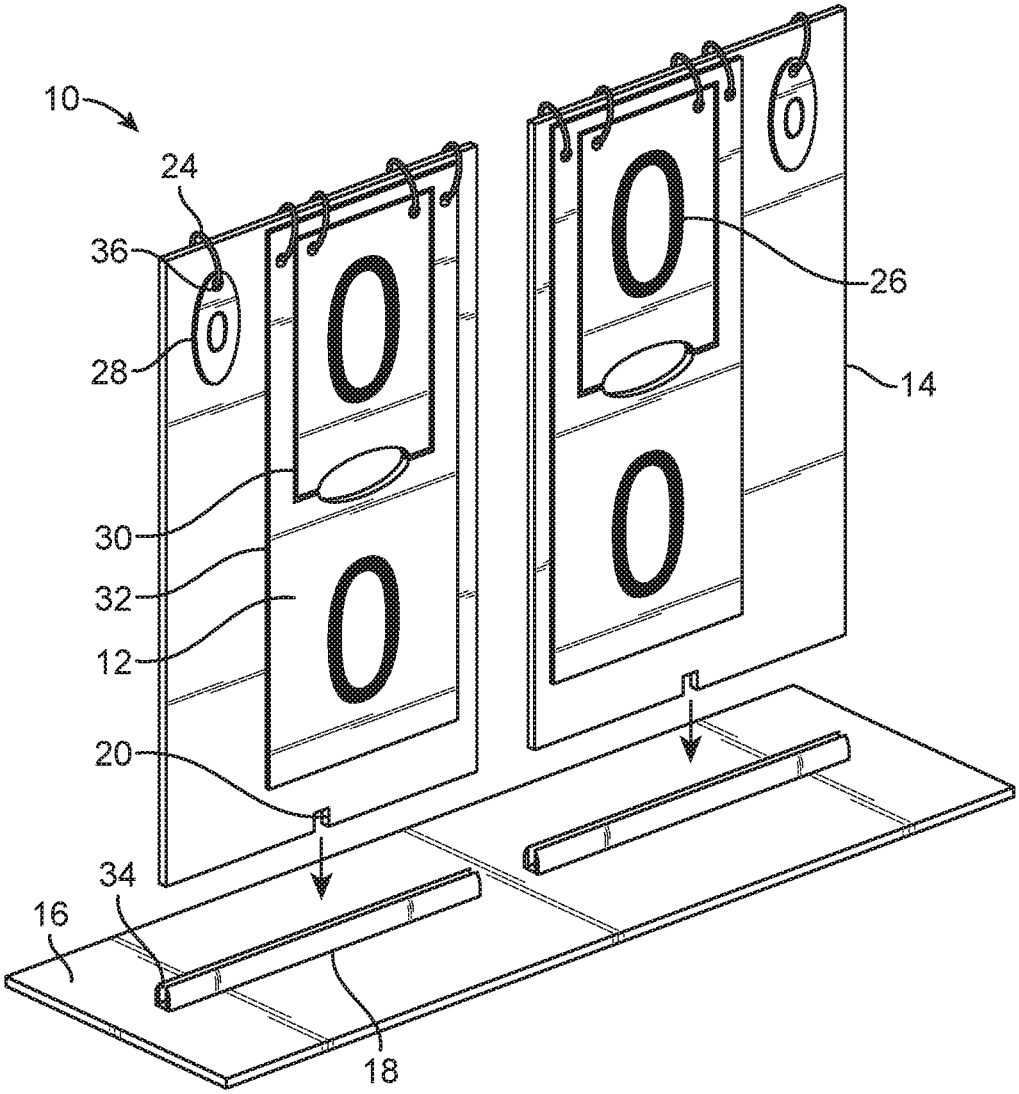
FIG. 2 exemplarily illustrates an isometric view of the scoreboard 10 in an embodiment of the present invention. The base member 16 receiving the support member 14 is illustrated.
Figure 3:
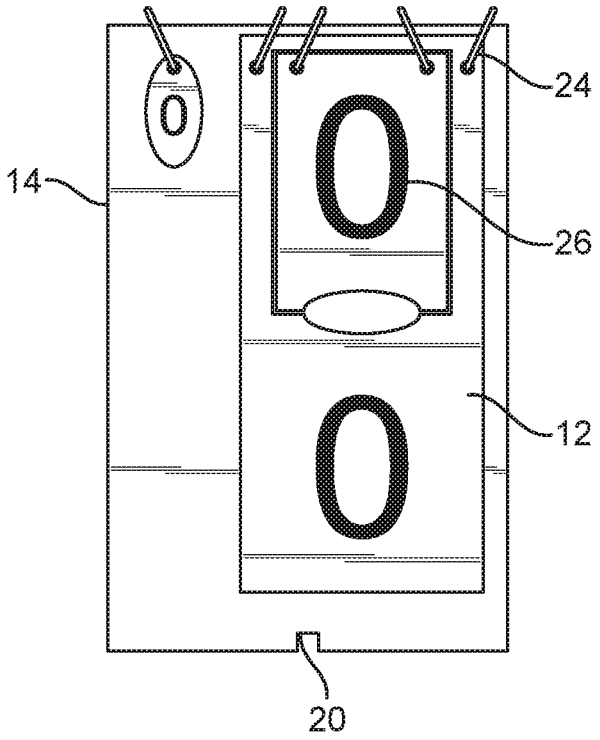
FIG. 3 exemplarily illustrates a front view of the support member 14 with a plurality of cards 12 in an embodiment of the present invention. The support member 14 comprising a cavity 20 at a bottom portion is illustrated.
Figure 4:
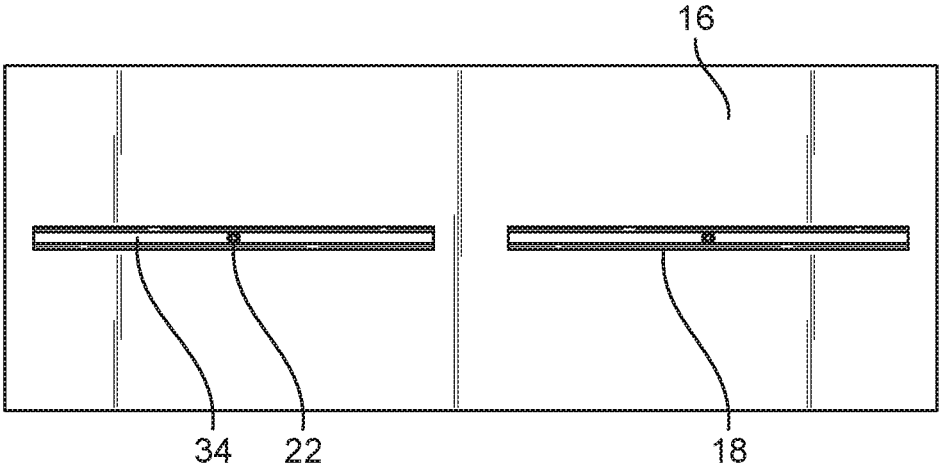
FIG. 4 exemplarily illustrates a top view of the base member 16 in an embodiment of the present invention. The base member 16 comprises a bracket member 18 with a mating member 22 that attaches to the cavity 20 of the support member 14 is illustrated.

Referring now to the drawings, FIGS. 1-4, where the present invention is generally referred with numeral 10, it can be observed that a scoreboard 10 for scoring sporting events or other recreational events is disclosed.

The scoreboard 10 includes a support member 14 disposed above a base member 16. A plurality of ring members 24 are aligned along the length of an upper portion of the support member 14. A plurality of cards 12 having indicia 26 are suspended from the plurality of ring members 24. The plurality of cards 12 are arranged in at least three stacks (28, 30, and 32) and have at least one fastening aperture 36 adjacent to a first end of each of a plurality of cards 12. The plurality of ring members 24 are positioned through each of the at least one fastening aperture 36. The plurality of cards 12 hang from the plurality of ring members 24 so that the plurality of cards 12 may be rotated or flipped around the support member 14 to permit alternate displays of the indicia 26 on the plurality of cards 12.

In one embodiment, each stack (28, 30, and 32) is disposed along the length of the support member 14. The three stacks (28, 30, and 32) of the plurality of cards 12 comprise a first stack 28, a second stack 32 and a third stack 30. In one embodiment, the first stack 28 and the second stack 32 are aligned in along the length of the support member 14. The second stack 32 comprises an upper open surface conforms to the shape of the third stack 32. The third stack 32 is disposed within the upper open surface of the second stack 32. In one embodiment, the support member 14 of the scoreboard 10 defines a plurality of holes to receive and assemble the three stacks (28, 30, and 32) of cards 12, via the plurality of ring members 24. The plurality of ring members 24 is threaded through each of these holes. This prevents lateral movement of the plurality of ring members 24 along the length of the support member 14 of the scoreboard 10.

In one embodiment, the plurality of cards 12 in the first stack 28 have numbers zero through nine sequentially. In one embodiment, the plurality of cards 12 in the first stack 28 are configured to indicate a number of games won. In one embodiment, the plurality of cards 12 in the second stack 32 have single digit numbers from zero through nine sequentially. In one embodiment, the plurality of cards 12 in the second stack 32 are configured to indicate single digit score. In one embodiment, the plurality of cards 12 in a third stack 30 have two-digit numbers sequentially. In one embodiment, the cards 12 in the third stack 30 are configured to indicate two-digit score.

In one embodiment, the plurality of ring members 24 may be fixedly attached to a portion of the support member 14 of the scoreboard 10 to prevent free rotation of the plurality of ring members 24 around the support member 14. The support member 14 comprises a cavity 20 at its bottom portion. The base member 16 comprises a bracket member 18 with a narrow cavity 34 and a mating member 22 that detachably attaches to the cavity 20 and holds the support member 14 in position. In one embodiment, the support member 14 is affixed to the base member 16 by any other suitable conventional fastening mechanism.

In one embodiment, the plurality of cards 12 may be one-sided for one side display option or may be dual-sided for two-sided display option. In a dual-sided embodiment, each of the plurality of cards 12 has a front face and a back face. In this embodiment, some of the plurality of cards 12 have indicia 26 on both the front face and the back face. The numbers on the front face are one number lower in sequence than the number on the corresponding back face of each of the plurality of cards 12 so that the same score may be viewed from opposite directions in each stack.

In one embodiment, the scoreboard 10 is made of at least one a material selected from a group including, but not limited to, metal, plastic, aluminium, wood or composite. In one embodiment, the plurality of cards 12 are constructed of plastic, styrene plastic, metal, plain or laminated paper, plain or laminated cardboard or any other suitable material. The cards plurality of cards 12 may be clear or opaque, colored or white. In one embodiment, the indicia 26 include lettering and numbers, which are sized and shaped to fit on a face of the plurality of cards 12 and are easily visible from a distance. In one embodiment, the scoreboard 10 may be 7 inches in height, 5 inches length and ¼ inches in width. In another embodiment, the base of scoreboard 10 may be 5 inches deep and 12 inches in length. In yet another embodiment, the dimension of the scoreboard 10 may vary according to the preference of the end user. In another embodiment, the scoreboard 10 comprises square, rectangular or any other shape. In one embodiment, the plurality of ring members 24 is made of at least one a material selected from a group including, but not limited to, metal, plastic, aluminum, wood or composite. Being that the present invention can be made of these materials it is easy to move or transport and easy to store as well as the present invention may be light weight. There may be a light weight box that aids in the storing and further the transporting of the dissembled scoreboard 10.

Advantageously, the present invention could be used for effectively displaying scores for any sporting events or recreational events such as court style sports or any other sporting events. The scoreboard 10 allows a scorekeeper to accurately display the score, and easily observe the movement of players to either side of a court. The scoreboard 10 eliminates the need of having two large cards side by side to show scores above 10. Further, in dual-sided display option, once players switch sides, the portable frame could be easily interchanged or even rotated, thereby eliminating the need of flipping of the cards from the starting position. It can be appreciated that the present invention is easy to assemble and dissemble for easy storing or easy transporting. When storing the scoreboard 10, it may be stored in a box or container of the likes. The box also allows for easy transporting of the scoreboard 10.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A scoreboard comprising:

a base member;

a support member disposed above said base member;

a plurality of cards arranged in stacks, said stacks further defined as a first stack, a second stack and a third stack, said first stack having a first stack height that is greater than a third stack height of said third stack, said second stack having a second stack height that is greater than said first stack height and said third stack height, the stacks are disposed along a length of said support member entirety in contact therewith, said third stack being entirely in constant abutting contact with said support member, said first stack being in constant abutting contact with said second stack, each of said plurality of cards defining at least one fastening aperture therethrough, wherein each of said plurality of cards comprises indicia, said indicia on said first stack being entirely above of said indicia on said second stack; and a plurality of ring members threaded through each of said at least one fastening aperture in said plurality of cards, said plurality of ring members engaged to said support member, whereby said plurality of cards hang from said plurality of ring members so that said plurality of cards are rotated around said support member to permit alternate display of said indicia on said plurality of cards.

2. The scoreboard of claim 1, wherein the plurality of cards in one of said stacks have numbers zero through nine sequentially.

3. The scoreboard of claim 2, wherein the plurality of cards in one of the stacks are configured to indicate a number of games won.

4. The scoreboard of claim 1, wherein the plurality of cards in one of said stacks have single digit numbers sequentially.

5. The scoreboard of claim 1, wherein the plurality of cards in one of said stacks have two-digit numbers sequentially.

6. The scoreboard of claim 1 wherein each of the plurality of ring members are fixedly attached to a portion of the support member to prevent free rotation of the plurality of ring member.

7. The scoreboard of claim 1, wherein the support member includes a cavity, said cavity being recessed into said support member, said cavity being centrally located along a bottom portion of said support member.

8. The scoreboard of claim 1, wherein the base member comprises a bracket member with a mating member, said mating member being centrally located on said bracket member.

9. The scoreboard of claim 8, wherein the mating member is detachably attached to the cavity and holds the support member in position.

10. The scoreboard of claim 1, wherein said base member is entirely flat and has a rectangular configuration.

11. The scoreboard of claim 1, wherein said support member is offset a predetermined distance from lateral edges of said base member, thereby defining a spacing between the support member and the lateral edges of said base member along an entire perimeter of said support member.

12. The scoreboard of claim 1, wherein said indicia of said first stack being vertically in line with the indicia of said second stack.

13. The scoreboard of claim 1, wherein said indicia of said third stack has dimensions less than dimensions of said indicia of said first stack and said second stack.

14. The scoreboard of claim 1, wherein said indicia of said second stack is on a lower half region of said second stack.

15. The scoreboard of claim 1, wherein said third stack has a shape which differs from that of said first stack and second stack.

16. The scoreboard of claim 1, wherein an opening is defined entirely below of said first stack and through said third stack, said opening extending a partial width of said first stack.

17. The scoreboard of claim 1, wherein said plurality of ring members securing said first stack to said support member extend through said first stack and said second stack simultaneously.

18. A scoreboard consisting of:

a base member, wherein the base member comprises a bracket member with a mating member, said mating member being centrally located on said bracket member;

a support member disposed above said base member, the support member includes a cavity, said cavity being recessed into said support member, said cavity being centrally located along a bottom portion of said support member, the mating member is detachably attached to the cavity and holds the support member in position;

a plurality of cards arranged in stacks, said stacks further defined as a first stack, a second stack and a third stack, said first stack having a first stack height that is greater than a third stack height of said third stack, said second stack having a second stack height that is greater than said first stack height and said third stack height, the stacks are disposed along a length of said support member entirety in contact therewith, said third stack being entirely in constant abutting contact with said support member, said first stack being in constant abutting contact with said second stack, each of said plurality of cards defining at least one fastening aperture therethrough, wherein each of said plurality of cards comprises indicia, said indicia on said first stack being entirely above of said indicia on said second stack, said support member being offset a predetermined distance from lateral edges of said base member, thereby defining a spacing between the support member and the lateral edges of said base member along an entire perimeter of said support member, said indicia of said first stack being vertically in line with the indicia of said second stack, said indicia of said third stack has dimensions less than dimensions of said indicia of said first stack and said second stack, an opening is defined entirely below of said first stack and through said third stack, said opening extending a partial width of said first stack; and a plurality of ring members threaded through each of said at least one fastening aperture in said plurality of cards, said plurality of ring members engaged to said support member, whereby said plurality of cards hang from said plurality of ring members so that said plurality of cards are rotated around said support member to permit alternate display of said indicia on said plurality of cards.

* * * * *